US009456718B1

(12) United States Patent
Myatt

(10) Patent No.: US 9,456,718 B1
(45) Date of Patent: Oct. 4, 2016

(54) PAPER TOWEL AND TOILET PAPER PORTABLE DISPENSER

(71) Applicant: Patricia Ann Myatt, Willingboro, NJ (US)

(72) Inventor: Patricia Ann Myatt, Willingboro, NJ (US)

(73) Assignee: Patricia Myatt, Willingboro, NJ (US)

( * ) Notice: Subject to any disclaimer, the term of this patent is extended or adjusted under 35 U.S.C. 154(b) by 0 days.

(21) Appl. No.: 14/145,230

(22) Filed: Dec. 31, 2013

(51) Int. Cl.
*B65H 75/14* (2006.01)
*A47K 10/38* (2006.01)
*B65H 75/18* (2006.01)

(52) U.S. Cl.
CPC ..... *A47K 10/3827* (2013.01); *B65H 75/14* (2013.01); *B65H 75/185* (2013.01)

(58) Field of Classification Search
CPC .... B65H 75/185; B65H 75/14; B65H 75/22; Y10T 225/247; A47K 10/3827
USPC ..... 242/596, 588, 588.1, 588.3, 588.6, 404, 242/404.3
See application file for complete search history.

(56) References Cited

U.S. PATENT DOCUMENTS 851,835 A * 4/1907 Ramsey ..... 225/42
1,029,490 A * 6/1912 Connors et al. ..... 225/43
1,999,765 A * 4/1935 Laveau ..... 242/118.61
2,622,825 A * 12/1952 Faris ..... 242/118.61
2,978,156 A * 4/1961 Yaniello ..... 225/42
3,184,053 A * 5/1965 Eldridge ..... 242/588.6
3,228,579 A * 1/1966 Dong et al. ..... 225/23
D247,465 S * 3/1978 Ford ..... D6/523
5,031,852 A * 7/1991 Dowling et al. ..... 242/348.3
5,172,966 A * 12/1992 Myatt ..... 312/34.8
5,265,820 A * 11/1993 Enomoto ..... 242/348
5,354,009 A * 10/1994 Buelens et al. ..... 242/348.4
5,490,625 A * 2/1996 Myatt ..... 225/47
5,848,762 A * 12/1998 Reinheimer et al. ..... 242/595
6,045,087 A * 4/2000 Vislocky et al. ..... 242/608.6
6,182,921 B1 * 2/2001 Muylle et al. ..... 242/608.5
6,234,421 B1 * 5/2001 Cox et al. ..... 242/608.8
8,104,847 B2 * 1/2012 Colon et al. ..... 312/34.8
2004/0032045 A1 * 2/2004 Lepach et al. ..... 264/83
2011/0229241 A1 * 9/2011 Takahashi ..... 400/611
2011/0253830 A1 * 10/2011 Witwer et al. ..... 242/608.6
2013/0284852 A1 * 10/2013 Fuller et al. ..... 242/608.3
2014/0061351 A1 * 3/2014 Maruyama ..... 242/160.3

* cited by examiner

*Primary Examiner* — Emmanuel M Marcelo
*Assistant Examiner* — Michael Gallion

(57) ABSTRACT

The object of this invention is to provide an improved paper towel and toilet paper portable dispenser that will protect and cover a paper towel or toilet paper roll, so as not to become dirty when being transported. It will further allow the desired amounts of paper towels and toilet paper to be easily removed from the dispenser when needed. Not only is the dispenser light weight, flexible and simple and easy to use, it is economical in cost to manufacture.

4 Claims, 1 Drawing Sheet

Fig. 1
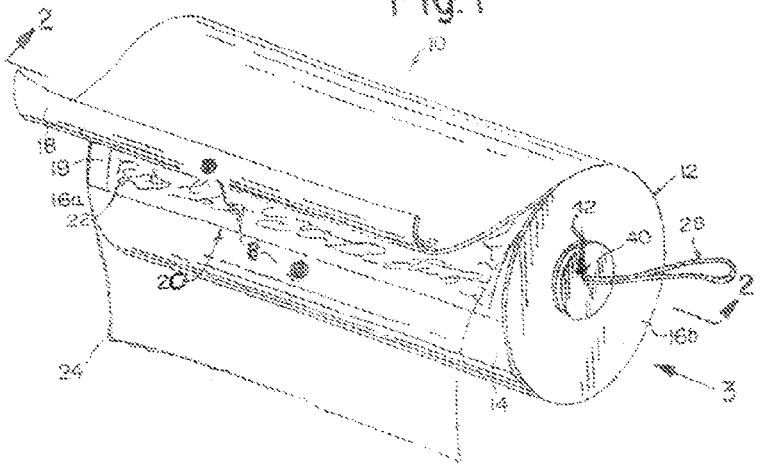
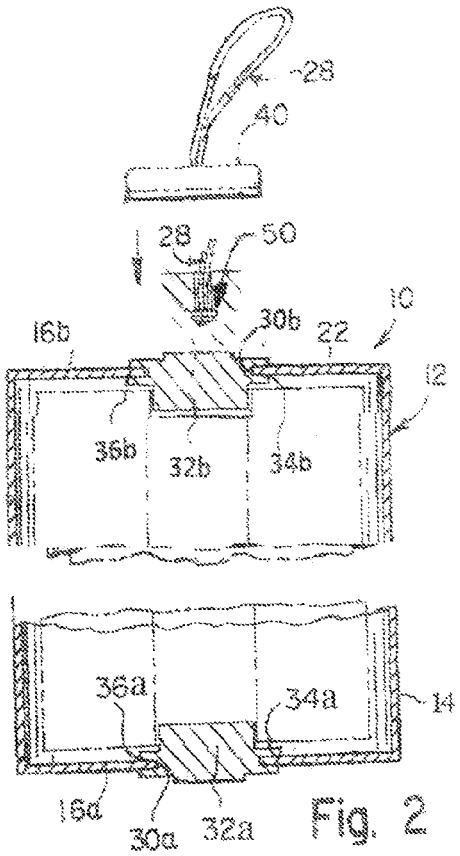
Fig. 2
Fig. 4
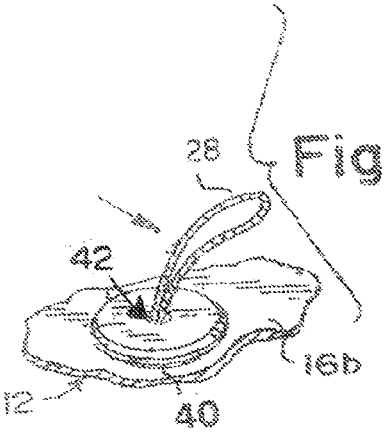
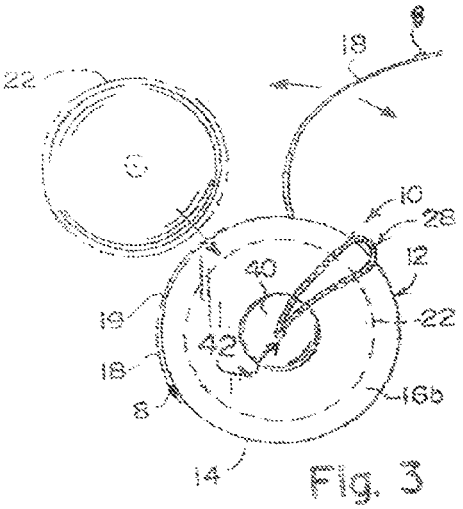
Fig. 3

PAPER TOWEL AND TOILET PAPER PORTABLE DISPENSER

BACKGROUND & SUMMARY OF THE INVENTION

The instant invention relates generally to paper towel and toilet paper holders and more specifically it relates to an improved paper towel and toilet paper portable dispenser.

Numerous paper towel and toilet paper holders have been provided in prior art that are adapted to be mounted to flat vertical surfaces or carried by a strap. For example, U.S. Pat. No. 851,835 to Ramsey; U.S. Pat. No. 1,029,490 to Connor; U.S. Pat. No. 2,978,156 to Yaniello; U.S. Pat. No. 5,172,966 to Myatt; U.S. Pat. No. 5,490,625 to Myatt; U.S. Pat. No. 5,848,762 to Reinheimer et al; U.S. Pat. No. 6,267,316 B1 to Devaney; Des. 394,572 to Cross; Des. 201,298 to Bahnsen; Des. 216,740 to Bye; Des. 223,049 to Brooks; Des. 235,932 to Douglas and Des. 247,465 to Ford all are illustrative of such prior art.

While these units may be suitable for the particular purpose to which they address, they would not be as suitable for the purposes of the present invention as heretofore described. A primary objective of the present invention is to provide an improved paper towel and toilet paper portable dispenser that will overcome the shortcomings of the prior art devices.

An additional object is to provide an improved paper towel and toilet paper portable dispenser with roll stub shaft mechanisms that allows the paper towel and toilet paper rolls to be quickly installed or removed from the portable dispenser.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Depending on the particular design choice for the length of the improved paper towel and toilet paper portable dispenser, the device can be used for both paper towel and toilet paper.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

BRIEF DESCRIPTION OF THE DRAWING FIGURES

The drawings are briefly described as follows:

FIG. 1 is a perspective view of the instant invention with the flap open and illustrating paper being torn off in phantom:

FIG. 2 is an enlarged cross sectional view with parts broken away of FIG. 1;

FIG. 3 is an end view taken in the direction of arrow 3 in FIG. 1:

FIG. 4 is a perspective view showing the end cap with carry strap element.

DETAILED DESCRIPTION OF THE PREFERRED EMBODIMENTS SPECIFICATIONS

Turning now descriptively to the drawings, in which similar reference characters denote similar elements throughout the several views, Figures illustrate an improved paper towel and toilet paper portable dispenser 10, which consists of a housing 12 having a cylindrical body 14, a pair of ends walls 16*a*, 16*b* and a longitudinal flap 18 between the end walls 16*a*, 16*b* to provide an opening 19 in the cylindrical body 14 of the housing 12. Component 20 is for rotatively retaining a roll 22 of paper toweling/toilet tissues within the cylindrical body 14 of the housing 12 between the pair of end walls 16*a*, 16*b*, so that a free portion 24 of the roll 22 can extend through the opening 19 in the cylindrical body 14 of the housing 12. An element 28 is affixed to one of the components 40 for carrying the dispenser 10.

The retaining components include the end walls 16*a*, 16*b* of the housing 12 having aligned apertures 30*a*, 30*b* there through. A pair of stub shafts 32*a*, 32*b* has enlarged flanges 34*a*, 34*b* with annular edge grooves 36*a*, 36*b*. The annular edge groove 36*a* in the enlarged flange 34*a* will engage with the first aperture 30*a* in the first end wall 16*a*, with the first stub shaft 32*a* extending into the cylindrical body 14. The annular edge groove 36*b* in the enlarged flange 34*b* will engage with the second aperture 30*b* in the second end wall 16*b*, with the second stub shaft 32*b* extending into the cylindrical body 14.

To use the dispenser 10, a person simply opens the flap 18 pulls out a free portion 24 of the roll 22 and tears off the desire amount of paper towel or toilet paper. The flap 18 can be reclosed with the mating magnet tabs 8 on the flap 18 and the cylindrical body 14, so as to hold in a releasable manner, the flap 18 to the cylindrical body 14 of the housing 12. The carry element 28 is a strap extending through the eye hole 42 of the end cap 40, on the second end wall 16*b* about the second aperture 30*b*, so that a person can grip the strap 28 and carry the dispenser 10 therefrom.

An end cap 40 has a eye hole 42 therethrough and is sized to fit over the second aperture 30*b*. The carry element 28 is a strap with a looped head that is passed through the eye hole 42 in the end cap 40 and is held in place by a threaded shank 50.

The second end wall 16*b* would also contain a stub shaft 32*b* with an enlarged flange 34*b* with angular edge groove 36*b*. The end cap 40 could be attached to either the first or second apertures 30*a*, 30*b*. The carry element 28 is a strap that could be eliminated from the second end cap 40. In other words, it is to be noted that while the end cap 40 is specifically illustrated to be of the fixed type, as is indicated by FIG. 4, the instant invention may alternatively have the end cap 40 interchangeable to either end of the device, and this is merely a matter of design-choice and well within the scope of the invention.

OPERATION OF THE INVENTION

To use the dispenser 10, a person simply opens the flap 18 pulls out a free portion 24 of the roll 22 and tears off the amount desired. The flap can be reclosed with the mating magnet tabs 8. The dispenser 10 is carried by the strap 28. To replace the roll 22, the flexible body 10 allows the roll to be inserted into the body by inserting each open end of the roll over the stud shafts, first 32*a* then insert open end of roll over stud shaft 32*b*. The roll can be removed by pulling up the center of the empty paper roll 22 then removing the empty roll 22 through the opening 19 and a new roll inserted.

What is claimed:

1. An improved paper towel and toilet paper portable dispenser, comprising:

a) a hollow cylindrical housing having a housing first end and a housing second end and containing a housing longitudinally disposed slot extending from said housing first end to said housing second end so that a roll of the paper towel/toilet paper can be removably inserted into said hollow cylindrical housing and a free portion of the roll is extendable through said housing longitudinally disposed slot;

b) housing first end wall disposed at said housing first end and containing a centrally disposed housing first end wall aperture circumferential edge, said centrally disposed housing first end wall aperture having a diameter less than that of said first end wall;

c) a housing second end wall disposed at said housing second end and containing a centrally second end wall aperture with a housing second end wall aperture circumferential edge, said centrally disposed housing second end wall aperture having a diameter less than that of said second end wall and being in alignment with said centrally disposed housing first end wall aperture, said cylindrical housing, said housing first end wall, and said housing second end wall defining a housing chamber;

d) a housing longitudinal flap covering said housing longitudinally disposed slot and extending from said first end wall to said second end wall so that the roll of paper towel/toilet paper contained in said housing chamber is protected;

e) two stationary stub shafts each having a stub shaft body with two enlarged flanges extending radially straddling said first end wall and said second end wall, said enlarged flanges having a circumferential edge containing a circumferentially disposed annular groove, said stationary stub shafts being mounted in said centrally disposed housing first end wall aperture and second end wall aperture with said circumferentially disposed annular groove receiving said housing first end wall and second end wall aperture circumferential edges, said stub shaft body extending into said housing chamber and retaining one end of the roll of the paper towel/toilet paper;

f) ;

g) ;

h) an end cap having an end cap lower end and a cap upper end;

wherein said end cap moves relative to each said stationary stub shaft.

2. The dispenser as defined in claim 1, further comprising carry means extending through said end cap.

3. The dispenser as defined in claim 2, wherein said carrying means is a strap so that a user can grip said strap and carry said dispenser.

4. The dispenser as defined in claim 3; further comprising knot and loop fasteners disposed on said housing longitudinal flap and said hollow cylindrical housing so that said housing longitudinal flap is releasably held to said hollow cylindrical housing.

* * * * *